US005934204A

United States Patent [19]

Oberle

[11] Patent Number: 5,934,204

[45] Date of Patent: Aug. 10, 1999

[54] SYSTEM FOR JOINING TWO PARTS ALONG THE FACING PLANAR SURFACES THEREOF

[75] Inventor: Jean-Marc Oberle, Cosswiller, France

[73] Assignee: Steelcase Strafor, Strasbourg, France

[21] Appl. No.: 08/930,418

[22] PCT Filed: Jan. 22, 1997

[86] PCT No.: PCT/FR97/00121

§ 371 Date: Feb. 19, 1998

§ 102(e) Date: Feb. 19, 1998

[87] PCT Pub. No.: WO97/26806

PCT Pub. Date: Jul. 31, 1997

[30] Foreign Application Priority Data

Jan. 23, 1996 [FR] France ..... 96 440007

[51] Int. Cl.[6] ..... A47B 3/06

[52] U.S. Cl. ..... 108/157.1; 108/157.16

[58] Field of Search ..... 108/157.1, 157.16, 108/157.18, 154; 248/188, 188.1; 403/321, 322.1, 294, 331

[56] References Cited

U.S. PATENT DOCUMENTS

| | | | |
|---|---|---|---|
| 735,618 | 8/1903 | Tannewitz | 403/321 |
| 1,448,642 | 3/1923 | Tomlinson | 108/157.16 |
| 1,793,709 | 2/1931 | Meyers | 108/157.16 |
| 2,110,718 | 3/1938 | Shiley | 108/157.16 |
| 2,175,572 | 10/1939 | Ruhl | 108/157.1 X |
| 4,944,235 | 7/1990 | Jahnke et al. | 108/154 X |
| 5,289,784 | 3/1994 | Waibel | 108/157.1 |
| 5,313,893 | 5/1994 | Kaneda et al. | 108/157.16 X |
| 5,755,164 | 5/1998 | Korte et al. | 108/157.18 |
| 5,758,988 | 6/1998 | Theodorou | 403/321 X |

*Primary Examiner*—Jose V. Chen
*Attorney, Agent, or Firm*—Abelman, Frayne & Schwab

[57] ABSTRACT

A system for assembling at least two parts along their facing flat-shaped surfaces, and is more particularly intended to be applied in the field of furniture, for connecting two horizontal panels forming a working surface to a single supporting sub-frame.

17 Claims, 5 Drawing Sheets

SYSTEM FOR JOINING TWO PARTS ALONG THE FACING PLANAR SURFACES THEREOF

The present invention concerns a system for assembling at least two parts along their facing flat-shaped surfaces, and is more particularly intended to be applied in the field of furniture, for connecting two horizontal panels forming a working surface to a single supporting sub-frame.

The latter can of course be also attached to a single working surface under equivalent conditions.

Devices are already know enabling these functions to be partially fulfilled. Thus, European patent EP 0 458 042 concerns a rotating locking system arranged under table tops and cooperating with pegs situated on the upper part of the supporting stands. Each stand may be either entirely situated under a single panel or distributed between two contiguous panels, of which the opposite edges then come into contact with each other.

The locking plate of the stand is provided with buttonholes cooperating with the said pegs and pivots about a vertical axis, which implies that of necessity it only occupies a limited area. In point of fact, a plate with a circular shape and having peripheral locking means designed to be applied to the edge of the table top must have a reasonable diameter so that it does not project, for obvious economic and technical reasons. Consequently, this system can only be applied in the region of angles, cooperating with conventional supports with a small section.

A system of this type additionally involves the sequential assembly of a first support, followed by a second, while the locking controls of each of the supports are not easily accessible since they are situated under the lower surface of each panel. From the point of view of assembly, the installation of supports under a single horizontal panel or under two horizontal panels attached by their transverse edges is equivalent.

A non-rotating system is disclosed in the U.S. Pat. No. 2,609,264. This system includes male elements designed to cooperate with slits, the first being situated on the sub-frames whereas the second are arranged under the panel. However, locking rods provided to attach the sub-frames to the said panel have a localized action, i.e. they are applied individually for each male element/slit couple When the panel forming the working surface of the desk is positioned on the sub-frames supporting it, it is thus necessary to inspect all the angular areas so as to lock the connections sequentially.

The same applies to the system disclosed in U.S. Pat. No. 2,987,262, which discloses an even more basic system. The elements for fixing the sub-frames to the panel are two in number, one being applied in a vertical direction while the other acts in a horizontal manner. Their interaction enables the panel to be locked onto the sub-frames. The operator responsible for assembly must also successively lock each connection in a manner which is moreover not very practical since the operations are to be carried out under the said panel.

The subject of the present invention on the contrary enables a sub-frame supporting one side of a panel or the two sides of two attached panels to be fastened in a single operation.

In addition, simultaneous locking of the sub-frame to the panel is carried out very easily, and can be achieved outside the volume covered by the said panel, in a single manoeuvre by the operator.

Similarly, simultaneous unlocking of all the fastening points along one or two edges (in the two aforementioned cases) is possible simply by carrying out a manoeuvre opposite to the preceding one.

The main objective of the invention is hence to simplify as much as possible the assembly and disassembly of a sub-frame to one or two horizontal panels.

To this en, in a very general manner, the invention consists of a system for assembling at least two parts along their facing flat-shaped contacting surfaces, the first comprising at least two perpendicular studs provided with a groove, each stud being able to be accommodated in an orifice in the second part, with which is associated a movable device parallel to it, on the opposite side to the surface facing the first part, the said device being capable of moving between a closed position locking the two parts against each other, and an open position in which they can be taken apart, characterized in that the perpendicular studs are distributed all along the contact surface, the movable device acting on them simultaneously by sliding along the second part, following an axis defined by the line joining the said studs.

The two parts referred to above are of course on the one hand a horizontal panel forming a working surface and on the other hand a sub-frame intended to support the said panel.

The considerable advantage obtained by the invention lies in the combined use of studs projecting from the lower surface of the working surface, and preferably situated in the angle areas, and of means for locking operated by sliding, cooperating simultaneously with all the said studs along one edge.

The shape of the sliding locking device has hence been the subject of a particularly detailed study on account of its dual cooperation on the one hand with the part in which it slides and on the other hand with the studs of the horizontal panel.

This movable device comprises a frame with an elongated appearance, the shape of which is designed to cooperate with the grooves in the studs by partially closing the orifices in the second part in the closed position, the said shape making it possible to free all the area of the said orifices when the device is slid in order to obtain the open position.

Preferably, the movable device comprises an elastic frame made of metal wire outlining curves obstructing part of the periphery of the areas of the orifices in the second part in the closed position.

In addition, so that it can be manipulated practically from outside the volume covered by the horizontal panel, it includes, at one of its ends, a gripping device extending beyond the surface of the second part, and enabling manipulation by sliding between the closed position and the open position.

This gripping device is designed so that it can be operated by simple tension or pressure exerted by the user's finger, without excessive effort, in a zone situated close to an edge of the horizontal panel forming the working surface.

This device cooperates closely with the second part, namely the sub-frame. In reality, mechanical interaction takes place in the upper part of the sub-frame, which is designed to support the horizontal panel, and which is referred to as the upper supporting bracket of the sub-frame.

This supporting bracket is in fact a shaped section comprising in particular a surface in which the orifices are made, designed to accommodate the studs on the first part, as well as the cut-outs, folds and embossed regions forming the slide of the movable device.

Situated at the top of the sub-frame, the said surface is flat and is configured horizontally so as to support the panel forming the working surface of the desk. It is consequently in this surface that the cut-outs, folds and embossed regions forming the slide are made, according to well-known manufacturing techniques which are easy to put into operation and considerably reduce manufacturing costs.

Preferably, the second part and the movable device are symmetrical about a middle plane which is parallel to the sliding axis and perpendicular to the facing surfaces, either side of which are made in particular two series of orifices designed to house the studs of the first two homologous parts.

When a sub-frame is associated with only one panel, the studs of the latter cooperate with a single set of orifices, those that are nearest to the lateral edge of the said panel, so that the sub-frame is included within the volume covered by the latter. The supporting bracket of the sub-frame is than adjacent to the lateral side of the said panel.

When used with two attached panels, the plane of separation or the plane of contact is coincident with the plane of symmetry.

With one or two panels, assembly is extremely simple, since it is sufficient to lodge the pegs or studs positioned under the panel into the corresponding orifices of the sub-frame. This is carried out naturally by using gravity, centering being facilitated by the fact that the studs are firmly attached to the upper part, the weight of which is consequently used during assembly.

As has been stated, the means for putting the invention into practice and the means of manufacturing the invention are not costly and the parts of the desk are assembled very rapidly, making the invention very attractive as regards economics.

The following is a detailed description of the system, with reference in particular to the accompanying drawings, in which.

The various figures show a preferred configuration of the invention, applied to assemblies of office furniture, and more specifically to the assembly of sub-frames to one or more horizontal panels forming working surfaces.

Figure 1:
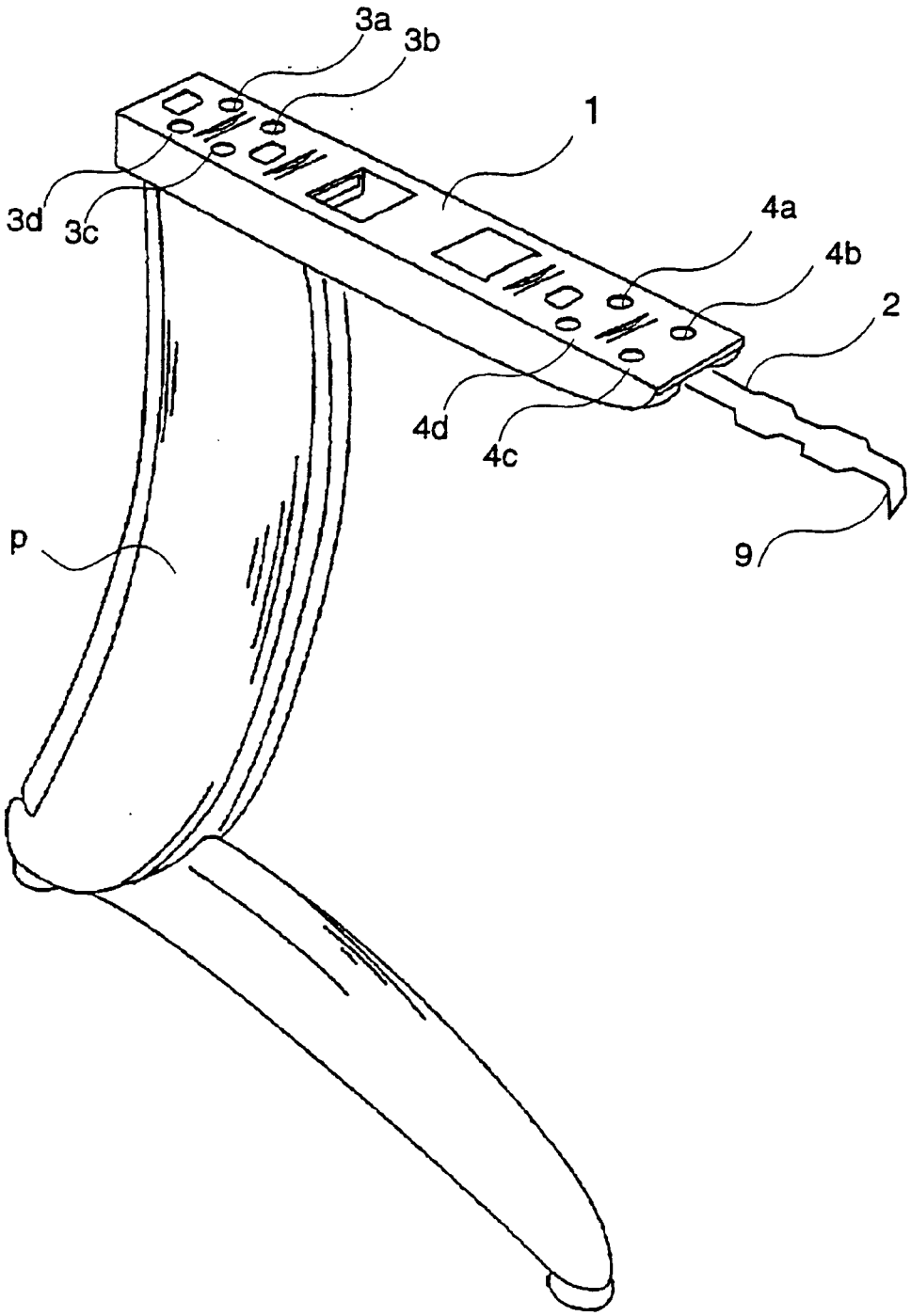
FIG. 1 is a perspective view of a sub-frame surmounted by a supporting bracket according to the invention.

In such a case, the part of the sub-frame p shown in FIG. 1 which directly relates to the invention, is the supporting bracket 1, cooperating with a movable locking device 2 enabling a horizontal panel to be locked, as will be explained in detail below. This is shown during assembly.

The upper surface of the supporting bracket 1 has orifices, folds and embossed regions of which the functions are differentiated and will be also clarified hereinafter.

Figure 2:
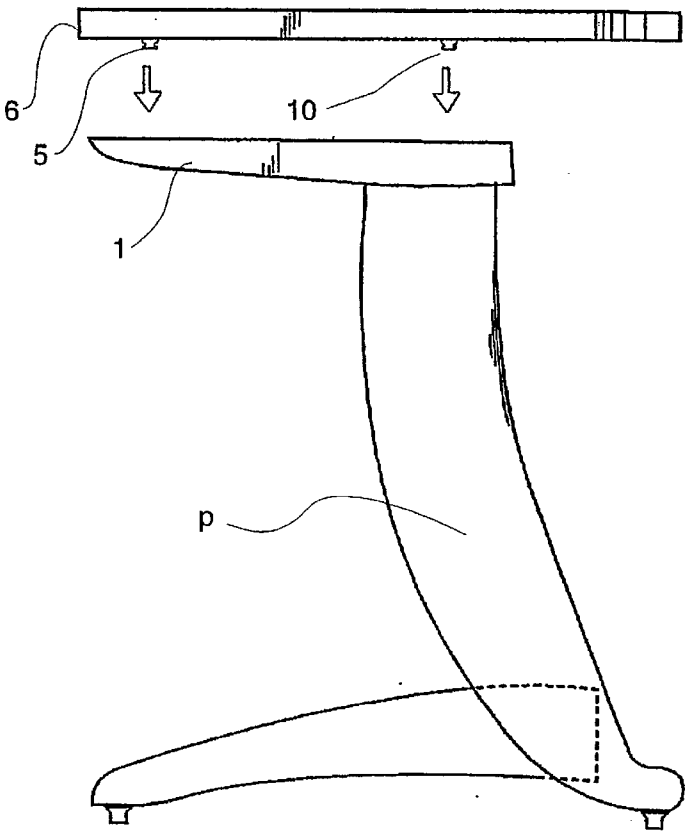
FIG. 2 is a side view showing a sub-frame and a horizontal panel being assembled.

The orifices 3*a* to 3*d* and 4*a* to 4*d* are mainly designed to ensure a connection between the pegs or studs 5 positioned on the lower surface of the horizontal panel 6 (see FIG. 2). According to a preferred configuration, each panel only carries two studs in the vicinity of an edge, spaced so that they cooperate with the orifices which are given identical reference letters (3*a*, 4*a*,; 3*b*, 4*b*, etc). In this case, the position can be adjusted between two distinct positions.

Nothing of course will prevent the said studs from being positioned differently, particularly if the panel is especially wide or heavy, or even from adding supplementary studs.

The movable device 2 slides in the supporting bracket, under the upper surface on which the horizontal panel 6 rests, and is made in wire form by a metal rod bent so that it can fulfil the function assigned to it. This consists of locking the studs 5 when the horizontal panel 6 rests on the supporting bracket 1, and when the said studs 5 are consequently inserted into the aforementioned orifices.

Figure 5:
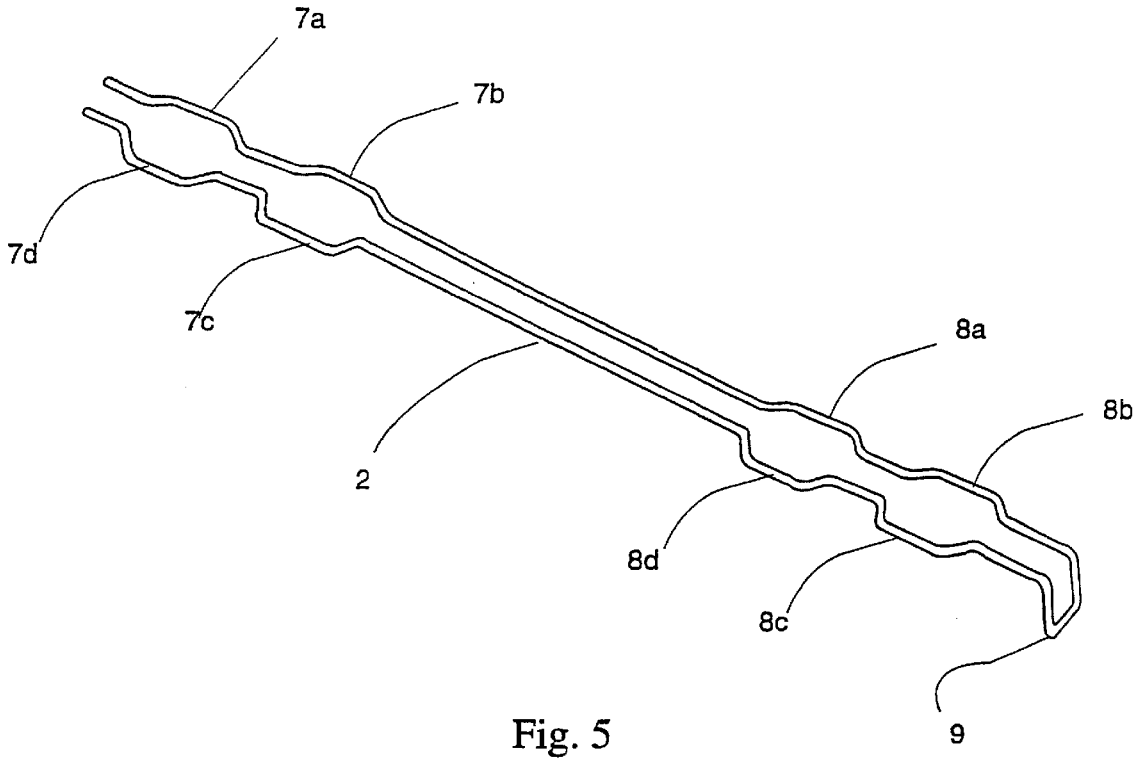
FIG. 5 is a perspective view of a movable locking device.

The movable device may be moved between a locking position and an unlocking position. The locking position is obtained when the device 2 butts up against the bottom of the supporting bracket 1, since the curves 7*a* to 7*d* and 8*a* to 8*d* (see FIG. 5) are then in the region of the orifices 3*a* to 3*d* and 4*a* to 4*d*, which they partially obstruct, cooperating in this way with groove 10 on the studs 5 when the latter are inserted.

Unlocking is obtained by pulling the movable device 2 with the aid of the turned-down end 9 acting as a gripping or manoeuvring device. The stroke between the locking position and the unlocking position is approximately 15 mm. The said movable device 2 is made simply and inexpensively with the aid of a metal rod folded and deformed so as to result in the configuration of FIG. 5.

Figure 3:
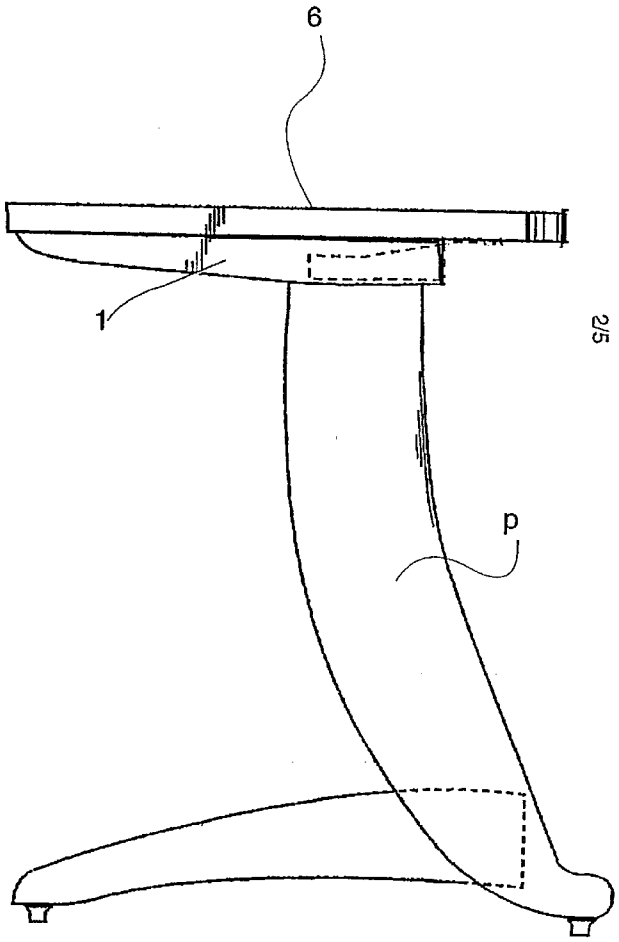
FIG. 3 shows the same assembly mounted together.

FIGS. 2 and 3 show the relative positions of the different components of the system when the assembly operation is being carried out and then completed. The movable locking device is in the out position in FIG. 2, and butted up inside the supporting bracket 1 in FIG. 3, in which the horizontal panel 6 is locked to the sub-frame p.

Figure 4:
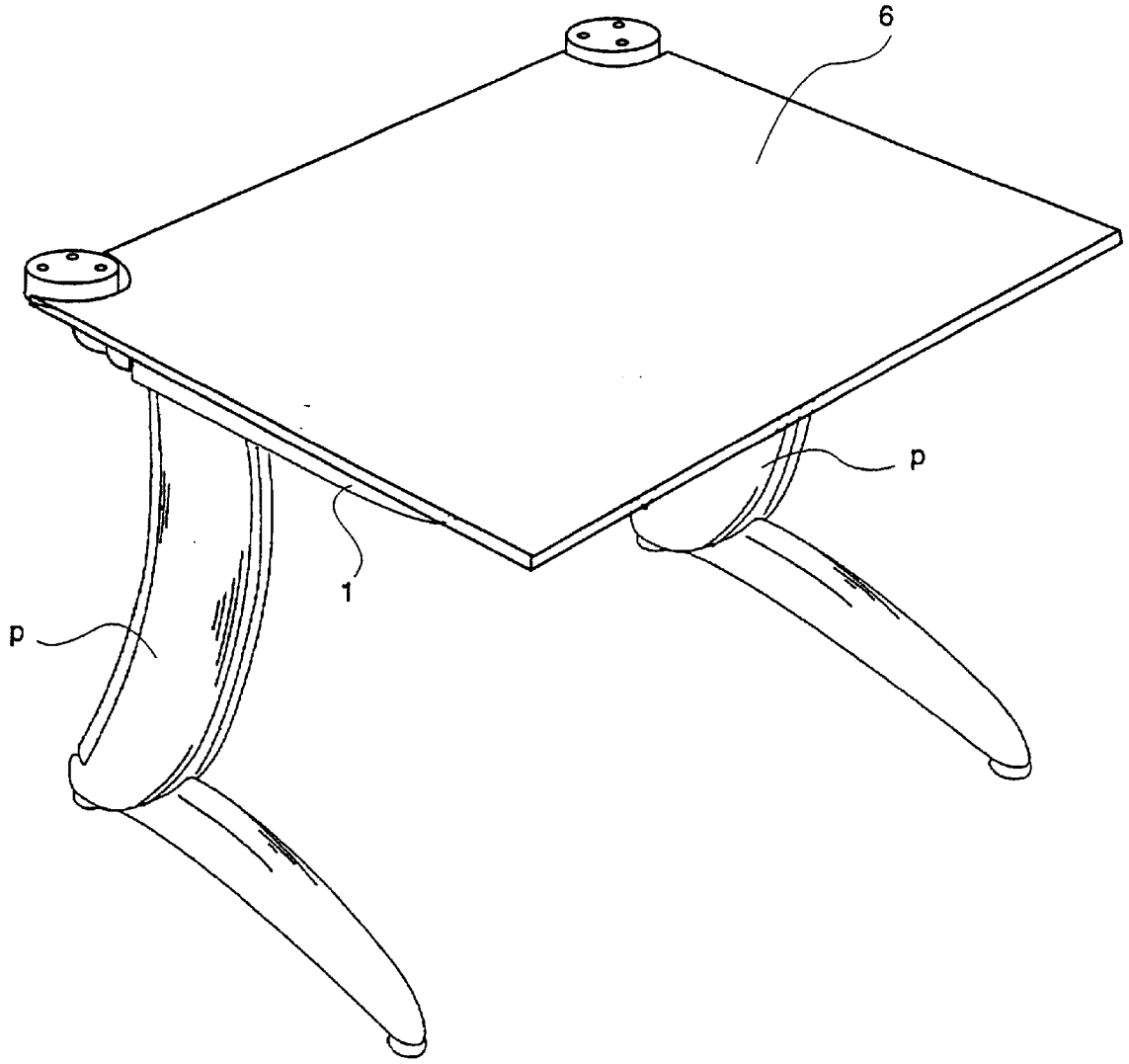
FIG. 4 shows an assembled desk in perspective.

FIG. 4 supplements FIG. 3 by showing the components of the desk in the fixed position. The two sub-frame p support the horizontal panel 6 which cannot be detached from them since the studs 5, which are four in number in this particular configuration, cooperate with the movable devices 2 butting up inside the supporting brackets 1. The manoeuvring component 9 of the said sliding device 2 is situated in the vicinity of the longitudinal edge of the panel 6, easily accessible to the user, but covered by the said panel 6 in the closed position.

Figure 6:
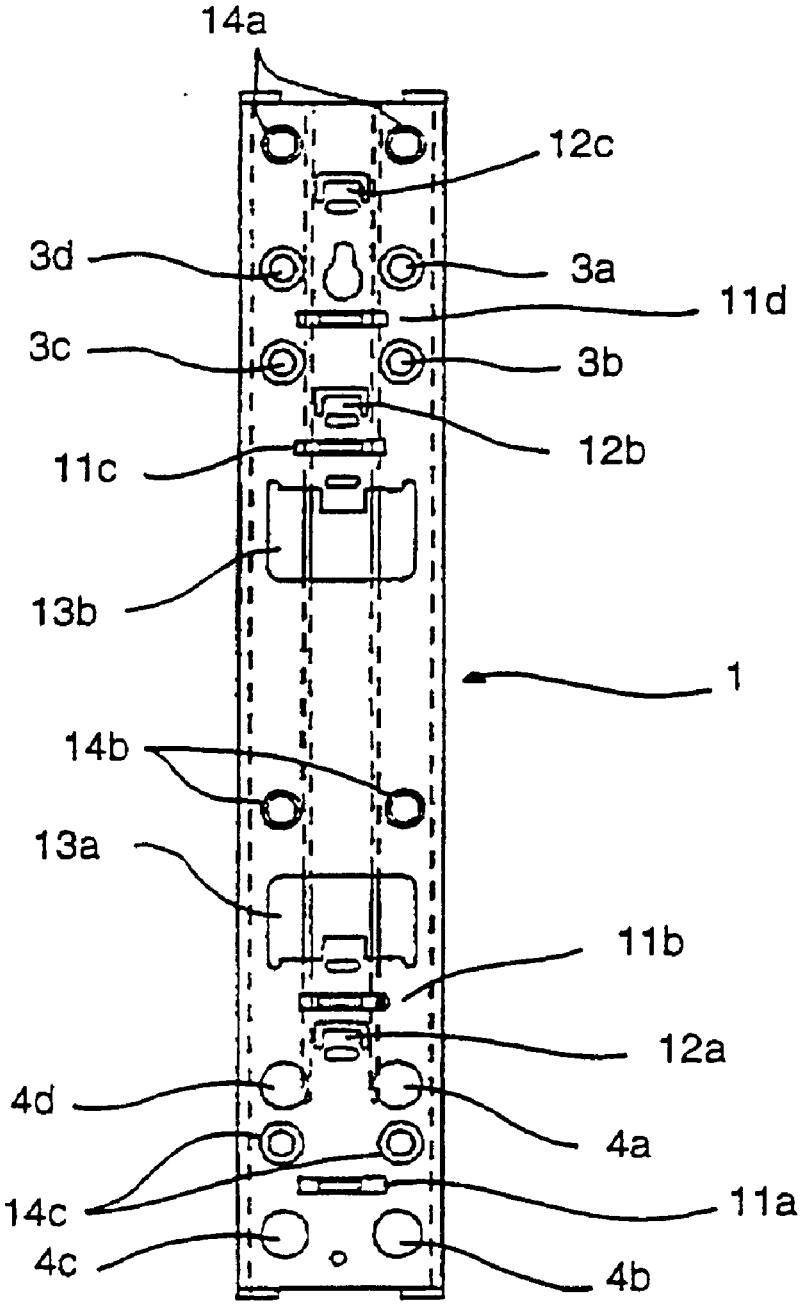
FIG. 6 is a view from above of a supporting bracket.

The slideway which enables the movable device 2 to slide is made by simple cut-outs, folds and embossed regions of various shapes in the upper surface of the supporting bracket 1. This will be seen in particular in FIG. 6.

Apart from the orifices designed to house the studs 5 of the upper panels 6, referenced 3*a* to 3*d* and 4*a* to 4*d*, the supporting brackets possess slits 11*a* to 11*d* obtained by cutting along two lines transversely to the supporting bracket, in the central part of the latter, and then by stamping out the zone situated between the two lines, which descends below the level of the upper surface of the supporting bracket and provides a space between them for guiding the movable device 2. This guide is preferably a guide designed to support the sliding element 2.

Central guiding is ensured by U-shaped slits 12*a* to 12*c* cut out in the upper surface, the parts delimited by these slits being then folded through 90°. The folded metal part thus created is inserted between the two arms of the folded rod forming the sliding device 9.

Additional guiding is providing by windows 13*a* and 13*b* also cut out on three faces and then folded through 90° and which also comprise a central slit similar to the aforementioned slits, i.e. providing central guiding.

Certain of the orifices formed in the supporting bracket 1 may additionally serve to house the end of a tab (not shown), the other end of which lodges in a corresponding orifice of an identical supporting bracket 1, with a view to attaching one to the other firmly.

Finally, the upper surface of the supporting bracket 1 carries pegs 14*a*, 14*b* and 14*c* which slightly project and have a flat upper surface, forming supporting zones arranged symmetrically to a longitudinal axis.

The preceding invention has been described by means of a preferred example, which cannot however be considered as limiting. On the contrary, the variants and modifications which fall within the contents encompassed by the accompanying claims form part of the invention.

I claim:

1. System for assembling at least two elongated members along their facing flat-shaped contacting surfaces, the first of said elongated members comprising at least two perpendicular stud (5) provided with a groove (10), each stud (5) adapted to be accommodated in a corresponding orifice (3*a* to 3*d*, 4*a* to 4*d*) provided in a sheet-like flat part of the second of said enlongated members which is associated with a movable device (2) parallel to said second elongated member, movable on the side of said sheet-like flat part opposite to the side facing the first of said elongated members, said movable device (2) being capable of moving between a closed position locking the two elongated members against each other, and an open position in which they can be taken apart, wherein the perpendicular studs (5) of the first elongated member are distributed along the surface provided to come into contact with the second elongated member, the movable device (2) acting on all of them simultaneously by sliding along the second elongated member, following an axis defined by a line joining the studs (5).

2. System for assembling at least two elongated members according to claim 1, wherein the movable device (2) comprises a frame with an enlongated appearance, said frame being configured to cooperate with the grooves on the studs (5) by partially closing the orifices (3*a* to 3*d*, 4*a* to 4*d*) in said sheet-like flat part of the second of said elongated members in the closed position, while allowing the surface of said orifices (3*a* to 3*d*, 4*a* to 4*d*) to be in the open position when the movable device is slid.

3. System for assembling at least two elongated members according to claim 2, wherein the movable device (2) comprises an elastic frame made of metal wire outlining the curves (7*a* to 7*d*, 8*a* to 8*d*) obstructing part of the periphery of the areas of the orifices (3*a* to 3*d*, 4*a* to 4*d*) provided in the said sheet-like flat part of the second of said elongated members in the closed position.

4. System for assembling at least two elongated members according to claim 3, wherein the movable device (2) comprises, at one of its ends, a gripping device (9) extending beyond the end of said sheet-like flat part of the second of said elongated members, whereby enabling manipulation by sliding it between the closed position and the open position.

5. System for assembling at least two elongated members according to claim 4, wherein the second of said elongated portions is a shaped section (1) comprising said sheet-like flat part in which the orifices (3*a* to 3*d*, 4*a* to 4*d*) are provided, adapted to accommodate the studs (5) of the first of said elongated members (6), as well as cut-outs, folds and embossed regions forming the slide of the movable device (2).

6. System for assembling at least two elongated members according to claim 5, wherein the second of said elongated members (1) and the movable device (2) are symmetrical about a middle plane which is parallel to the sliding axis and perpendicular to the facing contacting surfaces of said elongated members on, either side of which two series of orifices (3*a* to 3*d*, 4*a* to 4*d*) are provided, adapted to accommodate the studs (5) of at least the first of said elongated members.

7. System for assembling at least two elongated members according to claim 6, wherein the first of said elongated members is a table top (6) and the second of said elongated members is an upper supporting bracket (1) of a furniture pedestal-like sub-frame (p).

8. System for assembling at least two elongated members according to claim 1, wherein the movable device (2) comprises, at one of its ends, a gripping device (9) extending beyond the end of said sheet-like flat part of the second of said elongated members, whereby the movable device can be slid between the closed position and the open position.

9. System for assembling at least two elongated members according to claim 8, wherein the second of said elongated members is a shaped section (1) comprising said sheet-like flat part in which the orifices (3*a* to 3*d*, 4*a* to 4*d*) are provided, adapted to accommodate the studs (5) of the first of said elongated members (6), as well as cut-outs, folds and embossed regions forming the slide of the movable device (2).

10. System for assembling at least two elongated members according to claim 9, wherein the second of said elongated members (1) and the movable device (2) are symmetrical about a middle plane which is parallel to the sliding axis and perpendicular to the facing contacting surfaces of said elongated members on, either side of which two series of orifices (3*a* to 3*d*, 4*a* to 4*d*) are provided, adapted to accommodate the studs (5) of at least the first of said elongated members.

11. System for assembling at least two elongated members according to claim 10, wherein the first of said elongated members is a table top (6) and the second of said elongated members is an upper supporting bracket (1) of a furniture pedestal-like sub-frame (p).

12. System for assembling at least two elongated members according to claim 1, wherein the second of said elongated members is a shaped section (1) comprising said sheet-like flat part in which the orifices (3*a* to 3*d*, 4*a* to 4*d*) are provided, adapted to accommodate the studs (5) of the first of said elongated members (6), as well as cut-outs, folds and embossed regions forming the slide of the movable device (2).

13. System for assembling at least two elongated members according to claim 12, wherein the second of said elongated members (1) and the movable device (2) are symmetrical about a middle plane which is parallel to the sliding axis and perpendicular to the facing contacting surfaces of said elongated members on either side of which two series of orifices (3*a* to 3*d*, 4*a* to 4*d*) are provided, adapted to accommodate the studs (5) of at least the first of said elongated members.

14. System for assembling at least two elongated members according to claim 13, wherein the first of said elongated members is a table top (6) and the second of said elongated members is an upper supporting bracket (1) of a furniture pedestal-like sub-frame (p).

15. System for assembling at least two elongated members according to claim 1, wherein the first of said elongated members is a table top (6) and the second of said elongated members is an upper supporting bracket (1) of a furniture pedestal-like sub-frame (p).

16. System for assembling at least two elongated members according to claim 15, wherein when used with a single horizontal top panel, the supporting bracket (1) of the pedestal-like sub-frame (p) is close to the lateral edge of said table top (6).

17. System for assembling at least two elongated members according to claim 15, wherein when used with two horizontal top panels (6), the supporting bracket (1) is shared equally between the two horizontal top panels, the plane of separation, which is the vertical plane of contact between the side edges, being coincident with the plane of symmetry.

* * * * *